United States Patent [19]

Rayment

[11] 4,078,328

[45] Mar. 14, 1978

[54] CONSTRUCTION TOY SET

[75] Inventor: Larry W. Rayment, Battle Creek, Mich.

[73] Assignee: Sultra Corporation, Hickory Corners, Mich.

[21] Appl. No.: 698,949

[22] Filed: Jun. 23, 1976

[51] Int. Cl.[2] ..... A63H 33/10

[52] U.S. Cl. ..... 46/29

[58] Field of Search ..... 46/27, 28, 29

[56] References Cited

U.S. PATENT DOCUMENTS

| | | | |
|---|---|---|---|
| 3,195,266 | 7/1965 | Onanian | 46/29 |
| 3,458,949 | 8/1969 | Young | 46/29 |
| 3,648,404 | 3/1972 | Ogsbury et al. | 46/29 |

*Primary Examiner*—Louis G. Mancene
*Assistant Examiner*—Robert F. Cutting
*Attorney, Agent, or Firm*—Roger A. Johnston

[57] ABSTRACT

In a construction toy set, a connector unit or spider member has a central disk-shaped portion with a plurality of arms extending radially therefrom with each arm having a bulbous portion formed at the end thereof, the bulbous portion being slightly elongated in cross section in a direction transverse to the arm. A deformable plastic tube is received thereover in a manner which permits pivotal motion of the tube about the bulbous portion. The spider member has an aperture of slightly oval configuration formed in the central portion thereof for receiving a deformable plastic tube therein in frictional engagement therewith. The connector may also have a shoulder portion formed at the root of each arm for engaging the end of the plastic tube when assembled over the bulbous portion for restricting pivotal movement of the tube about the arm. A slot formed in the end of the tube permits alternate assembly thereof over the bulbous portion at substantially right angles to the arm with the slot in the end of the tube engaging the arm.

13 Claims, 7 Drawing Figures

CONSTRUCTION TOY SET

BACKGROUND OF THE INVENTION

This invention relates to construction toys and, more particularly, to toys adaptable for releasable connection with tubes.

Examples of construction toys of this general type may be found in U.S. Pat. Nos. 3,808,737 and 3,648,404.

The devices of the prior art, and particularly that shown in the above-referenced patents, employ connectors having a plurality of arms extending radially therefrom with bulbous or spherical portions formed thereon for receiving pivotally thereover a deformable tubular member. However, in the prior art the connection between the tubular member and the bulbous portion on the radial arm has been performed by slitting the bulbous portion to permit compressive deformation thereof. Another known construction toy provides for controlling the dimensions of the bulbous portion and the inside diameter of the tubular member so as to create a slight interference fit upon assembly. In either of these prior art types of pivotal connection, and particularly in the latter mentioned type, close control of the tolerances on the transverse diameter of the bulbous portion and the inside diameter of the tubular member have been required in order to provide the interference fit which causes frictional engagement of the tubular member with the bulbous portion. This close control of the tolerances of the connector or spider member and the tubular member has resulted in unnecessary and costly manufacturing procedures.

SUMMARY OF THE INVENTION

The present invention provides a solution to the above-described problem of providing a spider-type connector in a construction toy set of the type having a bulbous portion formed on the end of the arms radiating from the spider element with a tubular member received over the arm. The present invention provides the bulbous portion formed on each of the radiating connector arms with a slightly elongated cross section in a direction transverse to the arm. This elongated cross section of the bulbous portion permits a plastic tubular member to be assembled thereover in a frictional engagement by deforming the transverse cross section of the plastic tube, and thereby exerting friction between the inside diameter of the tube and the bulbous portion of the spider arm.

The present invention also employs a slightly oval aperture formed in the central disk portion of the spider connector, which aperture also has received therein in slightly transversely deformed manner, a plastic tubular member which is frictionally retained therein.

The present invention thus provides a substantially planar spider-like connector element which receives tubular members over the ends of its radiating arms and also receives a tubular member therethrough in a direction substantially at right angles to the plane formed by the radiating arms; and, thus serves as a connector for tubular members arranged in orthogonal position. The present invention permits ease of manufacture of the spider element by virtue of its substantially planar configuration, and also permits ease of manufacture of the tubular members by virtue of not requiring close control of the tolerances on the inside diameter thereof.

DETAILED DESCRIPTION

Figure 1:
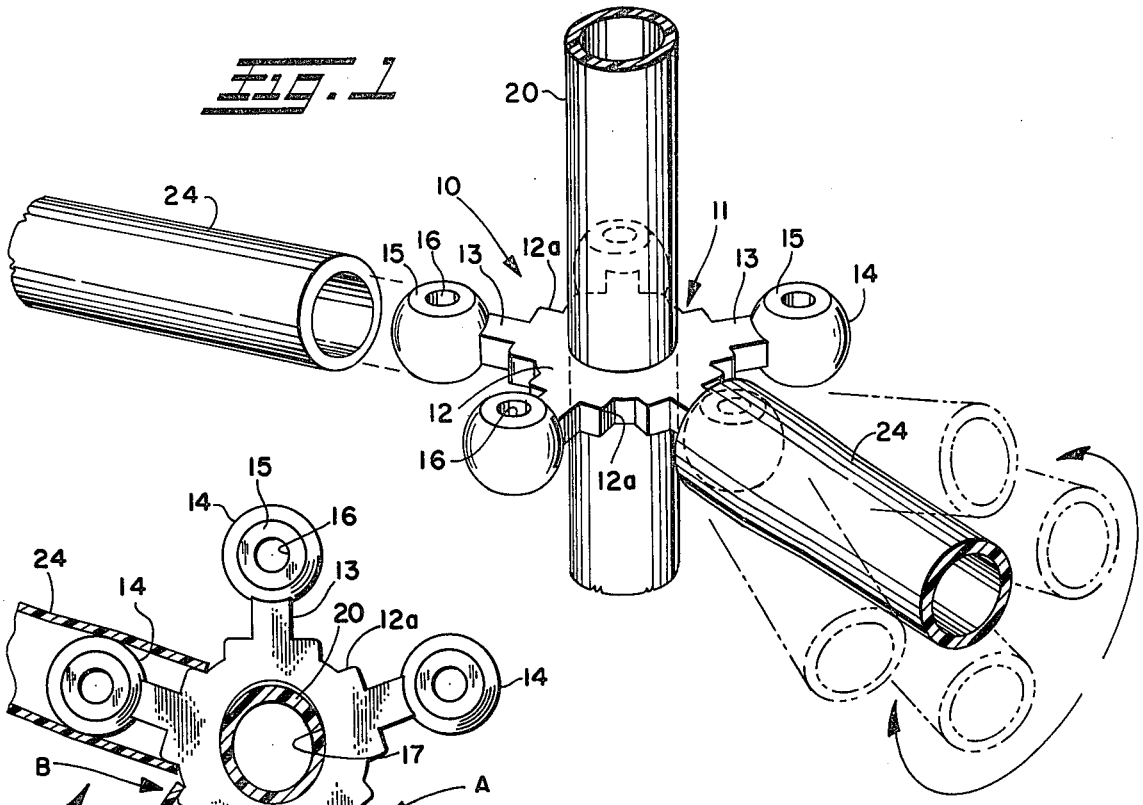
FIG. 1 is a perspective view of the connector of the present invention showing the tubular members assembled thereto over the bulbous portions of the radiating arms and also through the central aperture provided in the spider connectors.

Referring to FIG. 1, the plural piece construction toy set 10 has a connector or spider member 11, which connector has a central disk-like portion 12 which central portion has a plurality of arms 13 extending therefrom in radially outwardly arrangement and preferably in the plane of the central portion 12. Each of the arms 13 has a bulbous portion 14 formed on the free end thereof, with the bulbous portion 14 preferably formed of spherical configuration and truncated by a pair of spaced parallel planes passed therethrough parallel to the plane of the central portion 11. The truncated faces 15 of each bulbous portion 14 thus provide the bulbous portion 14 with the slightly elongated configuration in a direction transverse to the arm 13 as is illustrated in somewhat greater detail in FIG. 3. The connector portion 11 is preferably molded on plastic material and, for convenience in manufacture; however, the connector 11 may also be formed of other suitable materials, as, for example, metal or wood. It has been found desirable for convenience of manufacture to provide an aperture 16 through each of the bulbous ends 14 with the apertures 16 being disposed generally at right angles to the truncated face 15.

Figure 2:
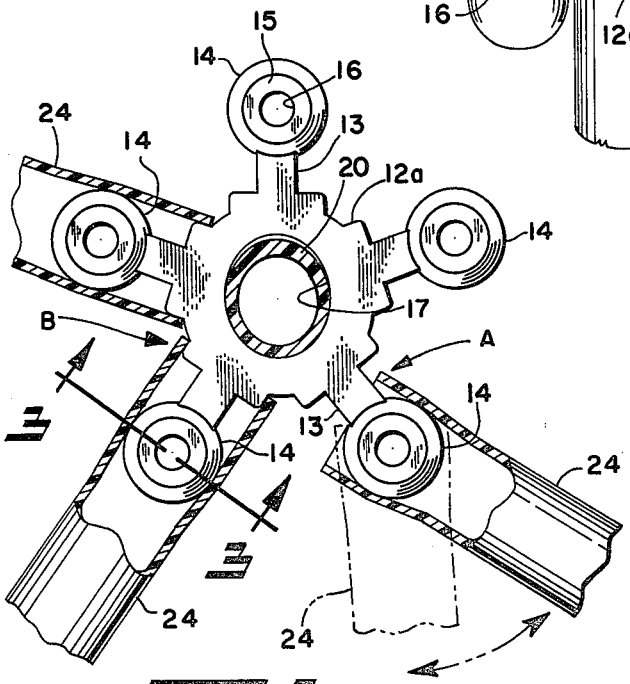
FIG. 2 is a plan view of the spider connector of FIG. 1 with tubes assembled thereon, and shows the tubes with portions thereof broken away to illustrate the radial connection to the spider member and the oval engagement of the central aperture.

At the root, or base, of each arm 13 is formed a shoulder portion **12*a* integral therewith and integral with the central portion 12 of the connector 11 with each shoulder 12*a* having generally the same thickness as the central disk-like portion 12. Each shoulder portion 12*a* has the width thereof in a direction transverse to the longitudinal direction of the arm 13 the same, or substantially the same, as the width of the bulbous portion 14 in a direction transverse to the arm 13. The connector 11 has an aperture 17 formed centrally through the central portion 12, which aperture 17 is slightly elongated or oval in configuration for receiving therein a tubular member 20 in frictional engagement therewith. The tubular member 20 has its wall thickness generally thin with respect to the outside diameter thereof and is formed of deformable, preferably plastic, material. In the unassembled, of free state, the tubular member 20 has the outside diameter thereof slightly larger than the minor diameter of aperture 17, but less than the largest diameter of aperture 17. When pushed through the aperture 17, the tubular member 20 is deformed slightly transversely with the wall of the tubing being elongated in the direction of the major diameter of the aperture 17, as illustrated in FIG. 2. The slight transverse deformation of the tubular member 20, upon insertion into the aperture 17, creates frictional forces between the outside diameter of the tubular member 20 as it tends to spring back to its original round configuration. The tubular member 20 is thus frictionally retained in the apertures 17 and connector 11**.

Figure 3:
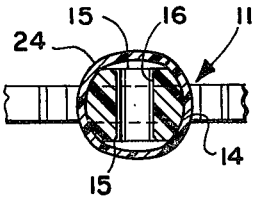
FIG. 3 is a section view taken along section lines 3—3 of FIG. 2, and shows the elongated configuration of the bulbous portion of a typical spider arm.
Figure 5:
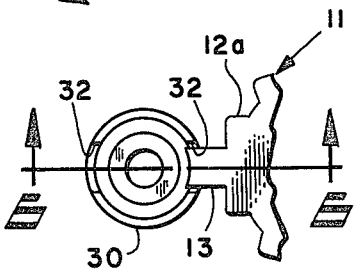
FIG. 5 is a fragmentary view of the spider member having one of the tubular elements received over the bulbous portion of an arm in an alternative arrangement and at substantially right angles to the central portion of the connector.

With reference now to FIGS. 1, 2 and 3, a second tubular member 24 is provided and is formed of resiliently deformable, preferably plastic, material. Tubular member 24, in the undisturbed state, has the inside diameter thereof slightly smaller than the elongated or largest dimension of the spherical surface 14 in a direction transverse to arm 13, and the tube 24 has the wall thickness thereof generally thin with respect to its diameter. The tubular member 24 may be assembled over any one of the bulbous portions 14 provided on the end of the arms 13 by pushing the tubular member 24 thereover such that same is deformed in its transverse configuration, from a substantially circular cross section, to a deformed oval cross section as illustrated in FIG. 2 and FIG. 3. The tubular member 24, when assembled over the bulbous portion 14 to a first position noted by the letter A in FIG. 2, is frictionally retained over the bulbous portion 14, but may be pivoted thereabout as shown in phantom outline in FIG. 1. When the tubular member 24 is pushed further over the bulbous portion 14 to a second position denoted by the letter B in FIG. 2, the inside diameter of the tube 24 engages the shoulder 16 provided at the base of arm 13 as illustrated in FIG. 2. When the tubular member 24 is installed in position B in FIG. 2, the tubular member is prevented from being pivoted about the arm 13 in a direction transversely thereof. However, The tubular member 24 may be rotated about the radial axis of the arm 13 if a sufficient torque is applied thereto to overcome the friction between the bulbous portion 14 and the deformed inside diameter of tubular member 24. It will, of course, be understood that a tubular member 24 may be installed over each of the arms 13 of the connector 11, and that in FIGS. 1 and 2, the tubular members have been omitted from some of the arms for clarity of illustration.

Figure 4:
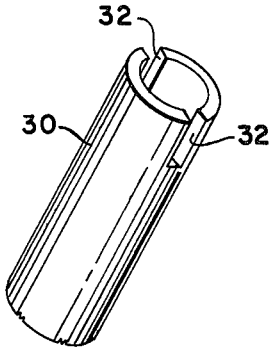
FIG. 4 is a perspective view of the end of one of the tubular members showing the optional slit formed therein.
Figure 6:
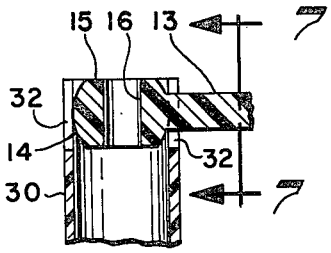
FIG. 6 is a partial section view taken along section indicating lines 6—6 of FIG. 5.
Figure 7:
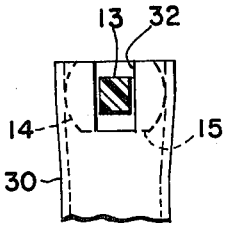
FIG. 7 is a partial sectional view taken along section indicating lines 7—7 of FIG. 6.

Referring now to FIGS. 4, 5, 6 and 7, an alternate arrangement of the tubular member 24 is shown in the form of the tubular member 30 having a slit 32 formed diametrally through one end thereof as illustrated in FIG. 4. The tubular member 30 may be assembled over the bulbous portion 14 on any of the arms 13 in a manner such that the longitudinal direction of the tube is generally at right angles to the arm 13. In this arrangement illustrated in FIGS. 5 and 6, the slot 32 engages the arm 13, intermediate the bulbous portion and the shoulder 16, such that the tubular member 30 may be pivoted about the bulbous portion 13 but may not be rotated about its own longitudinal axis.

The present invention thus provides a unique combination construction toy set in which a central spider-like connector having a plurality of arms with bulbous portions formed on the end thereof has each of the bulbous portions transversely elongated for receiving thereover resiliently deformable end of a plastic tubular member. In one position the plastic tubular member is made to pivot about the bulbous portion, and in a second position the tubular member is locked to prevent pivotal movement thereof about the arm of the connector. If desired, the tubular member may include a slot formed in the end thereof to permit assembly of the tubular member over the bulbous portion of the arm at generally right angles to the arm and permit pivotal movement of the tubular member thereabout in a plane generally at right angles to the arm. The spider member has an oval aperture formed in the disk-like central portion such that a resiliently deformable tubular member may be received therethrough and transversely deformed for frictional engagement therewith. The present invention thus permits assembly of one tubular member onto the bulbous portions on the end of each arm and/or through a central aperture and disposed generally at right angles to the direction of the arms. The present invention permits the tubular members to be made without close control of the tolerances of the diameters thereof and permits the bulbous portions of the connectors to be made without close tolerance control of the transverse dimensions of the bulbous portions. The construction of the present invention permits ease of assembly and assured frictional engagement between, respectively, the arms and the tubular members and between the central aperture and the tubular member by relying on oval deformation of the transverse section of the tubular member.

Modifications and variations of the present invention will be apparent to those having ordinary skill in the art having read the above teachings and the present invention is thus limited only by the spirit and scope of the following claims.

I claim:

1. A three dimensional connector for a construction toy set comprising:

(a) a central hub portion having an aperture formed therein;

(b) a plurality of arms integrally with said hub portion and extending radially outwardly therefrom with each of said arms having, (i) a bulbous portion formed at the free end thereof, said bulbous portion being elongated in a direction transversely of the respective arm upon which said bulbous portion is formed;

(ii) a shoulder portion formed at the base end of each of said arms where attached to said hub, said shoulder having a width dimension in a direction transverse to said arm substantially equal to the said transverse elongation of said bulbous portion, wherein said aperture has an oval configuration and is adapted for receiving therein a resiliently deformable tubular member.

2. The connector defined in claim 1, wherein said hub portion has a generally flat configuration with the thickness thereof substantially less than the smaller transverse dimension of said bulbous portion.

3. The connector defined in claim 1, wherein said bulbous portions each have an aperture formed transversely therethrough.

4. The connector defined in claim 1, wherein said bulbous portions each have two generally flat spaced parallel faces disposed on opposite sides of said bulbous portion.

5. The connector defined in claim 1, wherein each of said bulbous portions has a substantially spherical shape and is truncated in a pair of spaced parallel faces.

6. A construction toy set comprising:

(a) a connector having, (i) a central hub portion with an aperture formed therein, said aperture having an oval configuration, (ii) a plurality of arms formed integrally with said hub portion and extending radially outwardly therefrom in generally planar arrangement with said hub, with each of said arms having a bulbous portion formed at the end thereof with said bulbous portion being an elongated in a direction transversely of said arm, and, (iii) a shoulder portion formed at the base end of said arm where attached to said hub, said shoulder having the width thereof in a direction transversely of said arm substantially equal to the said transverse elongation of said bulbous portion, and (b) at least one tubular member formed of resiliently deformable material with the end of said tubular member received over the bulbous portion of one of said arms such that said tube is deformed transversely by said bulbous portion, said tube having a first position thereon with the end thereof spaced from said shoulder portion of said connector, said tube in said first position being pivotable and rotatable about said bulbous portion, said tube having a second position with the end thereof received over said shoulder portion of said connector in transversely deformed arrangement, said tubular member in said second position being locked to prevent pivotal movement about said arm.

7. The combination defined in claim 6 further comprising a second tubular member received in said oval aperture and disposed generally at right angles to the plane of said arms with the wall of said tube being transversely deformed by said oval aperture.

8. A construction toy set comprising:

(a) a connector having (i) a central hub portion with an aperture formed therein, said aperture having an oval configuration, (ii) a plurality of arms formed integrally with said hub portion and extending radially outwardly therefrom in generally planar arrangement, with each of said arms having a bulbous portion formed at the free end thereof with said bulbous portion being elongated in a direction transversely of said arm.

(b) at least one tubular member formed of resiliently deformable material having a slot formed in the wall of one end thereof, with said slotted end received over the bulbous portion of one of said arms, said tubular member being disposed at generally right angles to said arm with said slot engaging said arm intermediate said bulbous portion and said hub, such that the tubular member is pivotably movable about said arm and generally at right angles thereto.

9. A construction toy set defined in claim 8 further comprising a second tubular member formed of resiliently deformable plastic material received in said oval aperture, said second tubular member having the transverse shape thereof deformed by said oval aperture for creating friction forces therebetween for resisting removal of said second tubular member therefrom.

10. A construction toy set comprising:

(a) a connector having (i) a central hub portion of substantially planar configuration with an aperture formed therein, said aperture having an oval configuration;

(ii) a plurality of arms formed integrally with said hub portion and extending radially outwardly therefrom in generally planar arrangement, with each of said arms having a bulbous portion formed at the free end thereof with said bulbous portion being slightly elongated in a direction transversely of the said arm; and, (b) a tubular member formed of resiliently deformable material received in said aperture with the transverse shape of said member being deformed to an elongated configuration with said aperture being substantially undeformed for providing frictional retention of said member therein.

11. The construction toy set defined in claim 10 further comprising a second tubular member formed of resiliently deformable material having the inside diameter of one end thereof received over said bulbous portion of one of said arms with the transverse shape of said tubular member being deformed to an elongated configuration with the wall thereof being substantially unstretched said bulbous portion being substantially undeformed for providing frictional retention thereon yet permitting pivotal movement of said second tubular member about said bulbous portion.

12. A construction toy set comprising:

(a) a connector having (i) a central hub portion of substantially planar configuration, (ii) a plurality of arms formed integrally with said hub portion and extending radially outwardly therefrom in generally planar arrangement, with each of said arms having a bulbous portion formed at the free end thereof with said bulbous portions being elongated in a direction transversely of said arm; and, (b) a tubular member formed of resiliently deformable material having one end thereof received over said bulbous portion with the transverse shape of said member deformed to an elongated configuration with the wall thereof being substantially unstretched and with said bulbous portion being substantially undeformed for providing frictional retention thereon yet permitting pivotal movement of said tubular member about said bulbous portion.

13. A construction toy set comprising:

(a) a connector having (i) a central hub portion, (ii) a plurality of arms formed integrally with said hub portion and extending radially outwardly therefrom, with each of said arms having a bulbous portion formed at the free end thereof with each of said bulbous portions being elongated in a direction transversely of said arm; and, (b) a tubular member formed of resiliently deformable material having one end thereof received over the bulbous portion of one of said arms with the transverse shape of said tubular member deformed to an elongated configuration with the wall thereof being substantially unstretched and with said bulbous portion being substantially undeformed for providing frictional retention thereon yet permitting pivotal movement of said tubular member about said bulbous portion.

* * * * *